United States Patent [19]

Howard

[11] Patent Number: 4,985,998

[45] Date of Patent: Jan. 22, 1991

[54] KNIFE WITH BLADE LOCK

[76] Inventor: Durvyn M. Howard, Rt. 5, Box 77, Gasden, Ala. 35903

[21] Appl. No.: 434,996

[22] Filed: Nov. 9, 1989

[51] Int. Cl.[5] ..... B26B 3/06

[52] U.S. Cl. ..... 30/158; 30/160; 30/155

[58] Field of Search ..... 30/158, 160, 161, 155, 30/151

[56] References Cited

U.S. PATENT DOCUMENTS

| | | | |
|---|---|---|---|
| 616,689 | 12/1898 | Ruettgens | 30/158 |
| 1,234,345 | 7/1917 | Keenan | 30/158 |
| 4,120,088 | 10/1978 | Phelps | 30/160 |

*Primary Examiner*—Hien H. Phan
*Assistant Examiner*—Willmon Fridie, Jr.
*Attorney, Agent, or Firm*—Berman, Aisenberg & Platt

[57] ABSTRACT

A knife having a foldable blade includes a locking bar which holds the blade in an open position. A release lever is provided on the side of the handle for releasing the locking bar and allowing the blade to be moved to a closed position. The release lever has a laterally exposed portion which is flush with the outer surface of a bolster of the knife and a projection which extends into the recess which receives the blade when the knife is closed. The projection engages the bottom surface of the locking bar and urges it upward when the laterally exposed portion is depressed.

7 Claims, 1 Drawing Sheet

KNIFE WITH BLADE LOCK

TECHNICAL FIELD

This invention relates to mechanisms for releasing the locking lug of a foldable knife blade.

BACKGROUND ART

A wide variety of locking mechanisms are known for engaging the back of a foldable blade of a knife for securing the blade in an open position. In one known mechanism, a locking bar is pivotally mounted to an upper part of the frame of the knife, and the pivotal connection is at a location intermediate the ends of the locking bar. One end of the locking bar engages the upper surface of the blade when the blade is in the open position to hold it in that position. When the end of the locking bar remote from the end which engages the blade is depressed, the end which engages the blade is raised and releases the blade to allows it to pivot to a closed position.

This mechanism is awkward to use because the user's grip on the handle must be altered to be able to depress the end of the locking bar which is remote from the blade.

SUMMARY OF THE INVENTION

In accordance with the invention, a knife is provided having a pivotally mounted blade and a locking bar for holding the blade in an open position. A release lever is pivotally mounted to a bolster such that it is easily engaged by the thumb of a user without significantly altering the grip of the user. The release lever disengages the locking bar from the blade to greatly facilitate the operation of the blade of a knife constructed according to the invention.

The release lever comprises a first portion which lies along the side of the knife for being easily engaged by the user. A second portion of the release lever is a projection which extends inward to lie beneath the locking bar. When the first portion is depressed, the projection moves upward to push the locking bar out of engagement with the back of the blade to allow the blade to fold into a recess in the handle of the knife.

The release lever is mounted in a recess in the bolster such that its outer surface is flush with the outer surface of the bolster. This results in a release mechanism which is easily used and which does not interfere with the use of the knife.

An object of the invention is to provide a release mechanism for the blade of a knife which is safe, unobtrusive, and allows one-hand operation.

DETAILED DESCRIPTION OF THE PREFERRED EMBODIMENT

Figure 1:
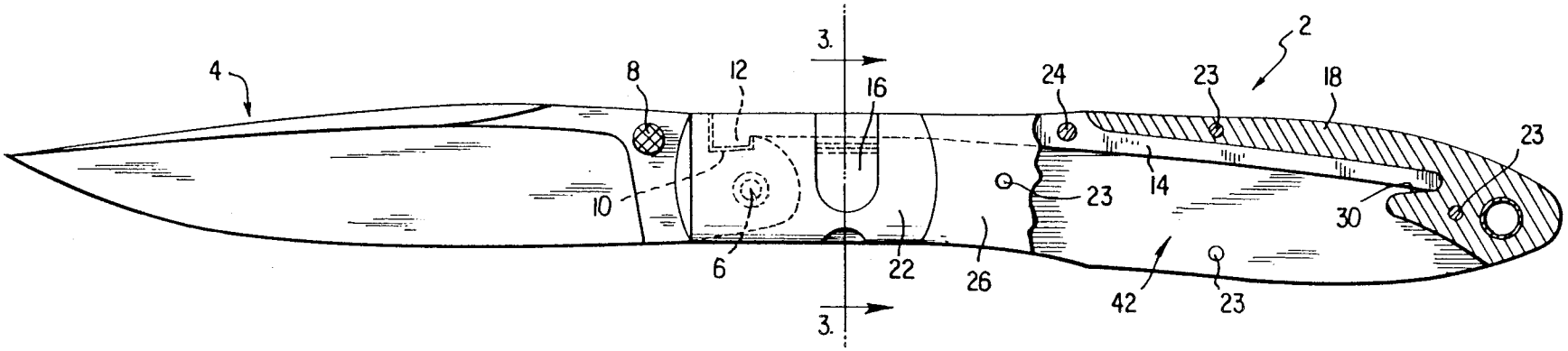
FIG. 1 is a side view of a knife according to the invention in partial cross section with the blade in an open position and showing hidden interior parts in phantom lines.

With reference to FIG. 1, a knife according to the invention includes a handle 2 and a folding blade 4. The blade is pivotally attached to the handle at pin 6, as is known in the art. An opening pin 8 is positioned to be engaged by the thumb of a user to move the blade to an open position. The rear end of the blade 4 has a notch 10 for receiving a locking lug 12 on a locking bar 14. The locking lug 12 holds the blade in an open position until it is lifted from engagement with the notch by operation of release lever 16 in a manner which will be more fully described below.

Figure 3:
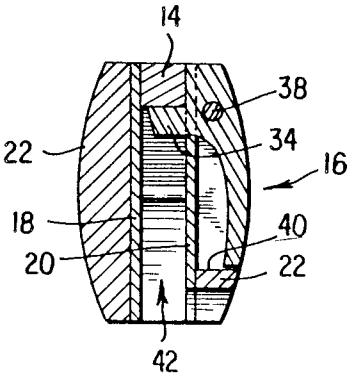
FIG. 3 is a cross section taken along line 3—3 of FIG. 1.

The locking bar 14 is held between two frame members 18 and 20 (see FIG. 3). Rivets 22 secure the parts together and hold decorative outer pieces 26 to the frame. A rivet 24 secures the locking bar to the frame members and provides a pivot point for spring operation of the locking bar 14. A spring retainer 28 is also held between the frame members and provides a recess 30 for receiving one end of the locking bar 14.

Figure 2:
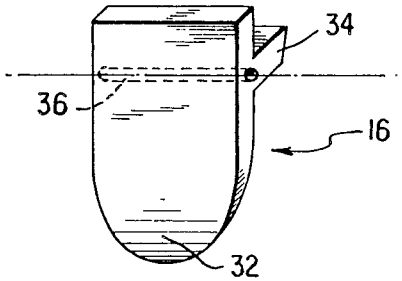
FIG. 2 is a perspective of a release lever used with the knife shown in FIG. 1.

The release lever 16 is shown in perspective in FIG. 2 and comprises a laterally exposed portion 32 and a projection 34. A hole 36 receives a pin 38 (see FIG. 3) for pivotally mounting the release lever to a bolster 22. The release lever is received in a recess 40 in a bolster 22 on one side of the knife, and the projection 34 extends through the frame member on that side of the knife into the recess 42 which receives the blade 4 when in the folded position.

The upper surface of the projection engages a lower surface of the locking bar 14. Depression of the laterally exposed portion of the release lever rotates the release lever about pin 38, and the projection 34 urges the locking bar upward to disengage the locking lug 12 from the notch 10 to release the blade and allow it to be folded into the recess 42. Moreover, the bottom surface of the projection 34 engages the bottom of the shank of the blade when in the folded position to act as a stop to prevent engagement of the sharpened portion of the blade with the spring retainer 28 or the locking bar 14.

In operation, the laterally exposed portion of the release lever is easily engaged by the thumb of the user to release the locking bar to allow the blade to be folded to a closed position. The laterally exposed portion 32 is preferably flush with the exterior surface of the bolster to provide a pleasing appearance and to prevent it from being accidentally depressed, which would release the blade.

Modifications of the invention within the scope of the appended claims will be apparent to those of skill in the art.

I claim:

1. A knife comprising a handle, a blade pivotally mounted to said handle, locking bar means mounted on said handle for engaging said blade when said blade is in an open position, a release lever comprising a lateral portion and a projection extending transverse to said lateral portion, and means for pivotally mounting said release lever to said handle, wherein said lateral portion includes an outer surface which is of a width sufficient to be engaged by the thumb of a user and depressed without said thumb engaging said handle and which is substantially flush with the surface of said handle adjacent said lateral portion before said lateral portion is depressed, said handle includes a recess for receiving said lateral portion when said lateral portion is depressed, and said projection engages a surface of said locking bar upon depression of said lateral portion for disengaging said locking bar from said blade.

2. A knife according to claim 1 wherein said projection extends below a lower surface of said locking bar and engages said lower surface when said release lever is rotated to push a portion of said locking bar upward to disengage said locking bar from said blade.

3. A knife according to claim 2 wherein said handle comprises a bolster attached to a frame, and said release lever is pivotally mounted to said bolster.

4. A knife according to claim 3 wherein said means for pivotally mounting said release lever comprises a pin which engages said bolster and extends in a direction generally parallel to the longitudinal axis of said handle.

5. A knife according to claim 4 wherein said handle comprises a recess for receiving said blade when said blade is in a closed position, and said projection extends into said recess.

6. A knife according to claim 6 wherein said bolster includes said recess for receiving said lateral portion such that said outer surface of said lateral portion is flush with an adjacent outer surface of said bolster before said lateral portion is depressed.

7. A knife according to claim 6 wherein said bolster includes a recess for receiving said release lever such that an outer surface of said release lever is flush with an adjacent outer surface of said bolster.

* * * * *